US010728977B1

(12) United States Patent
Chaimberg et al.

(10) Patent No.: US 10,728,977 B1
(45) Date of Patent: Jul. 28, 2020

(54) SYSTEM AND METHOD FOR INDEPENDENTLY ADJUSTING COLOR AND BRIGHTNESS OF LED'S OF DIFFERENT CCT OF A LIGHT SOURCE

(71) Applicant: GLOBE ELECTRIC COOMPANY INC., Montreal (CA)

(72) Inventors: Adam Chaimberg, Hampstead (CA); Jay Allard, Laval (CA); Xianwen Xiong, Lin'an Hang Zhou (CN)

(73) Assignee: GLOBE ELECTRIC COMPANY INC., Montreal (CA)

( * ) Notice: Subject to any disclaimer, the term of this patent is extended or adjusted under 35 U.S.C. 154(b) by 0 days.

(21) Appl. No.: 16/501,979

(22) Filed: Jul. 16, 2019

(51) Int. Cl.
*H05B 45/20* (2020.01)
*H05B 45/10* (2020.01)
*H05B 47/19* (2020.01)

(52) U.S. Cl.
CPC ..... *H05B 45/20* (2020.01); *H05B 45/10* (2020.01); *H05B 47/19* (2020.01)

(58) Field of Classification Search
CPC ..... H05B 45/20; H05B 47/19; H05B 45/10
USPC ..... 315/131
See application file for complete search history.

(56) References Cited

U.S. PATENT DOCUMENTS

2016/0044753 A1* 2/2016 Lee ..... H03K 7/08 315/185 R
2019/0342975 A1* 11/2019 Diana ..... F21S 8/00

* cited by examiner

*Primary Examiner* — Don P Le
(74) *Attorney, Agent, or Firm* — Guy J. Houle

(57) ABSTRACT

A system and method for independently adjusting the correlated color temperature (CCT) and brightness of a light source having two or more color LED's or LED sets, with each color LED or LED set having a different correlated color temperature. A user person can selectively enable a selected one of the two or more color LED's or LED sets and adjust the brightness thereof and repeat the selection of the second color LED or LED set and adjust the brightness thereof. By independently selecting the color LED or LED set and modifying the brightness thereof, a desired light atmosphere can be created by adjusting the output color mixture of the LED's or LED sets and controlling the brightness of the combination of the color LED's or LED sets. The selection of individual color LED's and the brightness adjustment thereof can be made by a mechanical operable control device or by remote wireless control device.

14 Claims, 5 Drawing Sheets

SYSTEM AND METHOD FOR INDEPENDENTLY ADJUSTING COLOR AND BRIGHTNESS OF LED'S OF DIFFERENT CCT OF A LIGHT SOURCE

FIELD OF THE INVENTION

The present invention relates to the field of LED lighting and in particular to LED light sources mounted in fixtures or otherwise and having two of more color LED's each having a different correlated color temperatures (CCT) and to a system and method permitting a user person to select and control the brightness of individual ones of the color LED's to create a desired combined and modified environmental light atmosphere.

BACKGROUND OF THE INVENTION

Color temperature can be described in terms of the color emitted by a light fixture with a spectrum from bright light, such as daylight, to warm soothing amber light such as at dusk. LED light sources do not exhibit visible spectrum radiation at all wave lengths of the spectrum and are measured according to a correlated color temperature (CCT) scale. It would be desirable for a user person to be able to control the brightness of individual sets of LED chips with the sets having different correlated color temperature from each other, to produce by the combination of the sets of LED chips, a desired light environment which is warm, cozy, relaxing or bright such as is desirable during dinning or working late over a desk top or in front of a computer or simply creating a bright environment in a working area. It is well known that bright light stimulates the senses of a person and can be disruptive to a person's health particularly when exposed to bright light at night time creating the effect of jet lag, poor sleep and lack of energy during the day. It could also lead to other adverse conditions such as disruption of vital hormone production. It is therefore desirable to provide a means to a user person to be able to control LED light sources to modify the environmental light to suit a specific period of time.

The unit of measure of color temperature of LED's is K for Kelvin, which is defined as the color temperature of an absolute blackbody when it is heated to a certain temperature and the radiation color of an LED light source is the same as that of an absolute blackbody. Different color temperatures will create different environments, such as when the color temperature is below 3000K, the light is red, giving people a warm and stable feeling. Suitable for household use, and which renders objects more colorful, is a color temperature higher than 5000K wherein the light color is blue, giving a sense of refreshment. Studies have shown, as mentioned above, that lower color temperatures can make people more likely to enter a resting state, while higher color temperatures can improve people's concentration.

The color temperature of LED fixtures and LED bulb devices having two sets of LED's of different CCT (correlated color temperature) can be adjusted to create a desirable light atmosphere. For current market products, users will use switch devices on LED fixtures and lamps to select the color temperature they need. The advantage of this method is that it can limit the inventory of having to stock several types of LED sets of different Kelvin color temperature, but the main disadvantage is that the color temperature needed by users must be selected before the installation of the light sources or fixtures, which is a great inconvenience.

As mentioned above, the brightness of LED sources and LED fixtures can be adjusted by adjusting a switch device on the fixture. It is known to use dimmer switches to adjust brightness of LED light sources. Dimmer switches are generally based on the principle of the use of silicon control rectifier chopper circuits. By adjusting the control button of the dimmer switch, the silicon control rectifier dimmer changes the energy transmitted to the LED, and its brightness output changes. Such dimmer control can only control and adjust the brightness.

There is a need to provide a new control device similar to a dimmer switch, which is installed on a wall or elsewhere or packaged differently for remote control and which can permit a user person to select a specific color LED or Led set and to change the color temperature and brightness of LED's, either directly on a wall control unit or remotely by a wireless control device with the signal transmitted by the control device and analyzed at any time by the circuitry controlling the color temperature and brightness to effect a color LED selection and establish a link to control the brightness thereof.

It is therefore a feature of the present invention to provide a system and a method which permits a user person to control an LED light source, having two or more color LED's or LED sets of different CCT, by permitting the user person to modify the color temperature and brightness of each of the LED's or LED sets in an LED light source by the use of a mechanical switch or a wireless electronic control switching means to produce a desired light environment.

Another feature of the present invention is to provide a system and a method to permit a user person to independently adjust the color temperature and brightness of two or more color LED's or LED sets in an LED light source, each having different correlated color temperatures (CCT) to create a desired light atmosphere in an environment and wherein the adjustment can be stored in a memory of a microcomputer.

A further feature of the present invention is to provide a system and method utilizing a novel system and circuit design to permit a user person to select a desired color LED or LED set mounted in an LED light source having two or more color LED's or LED sets of different correlated color temperatures and to control the brightness of a selected color LED or LED set and to repeat the control of the other color LED and also adjust the correlated color temperature thereof to create a desired light atmosphere by combining the two or more color LED's or LED sets by different CCT adjustments.

A still further feature of the present invention is to provide a novel control command signal by converting a section of the waveform of the supply voltage to include a specific number of half cycle binary code identifying a selected one of the LED's or LED sets of different CCT.

According to the above features, and from a broad aspect of the present invention, there is provided a system for independently adjusting the correlated color temperature (CCT) and brightness of a light source having two or more color LED's each having a different correlated color temperature. The system comprises signal conversion means for transmitting a command waveform containing a binary code representative of a control signal identifying a selected one of the two or more color LED's or LED sets as selected by a user person to enable the selected one of the two or more LED's or LED sets to receive a dimming brightness signal for brightness adjustment to create a desired light atmosphere in an environment lit by the adjustment of the brightness of each of the two or more color LED's or LED sets According to a further broad aspect of the present invention the selection of a color LED of the two or more color LED's or LED sets is effected by generating a control command waveform signal by modifying the supply voltage waveform by chopping selected half wave periods in a predetermined consecutive number of zero crossing intervals to generate a binary code signal including a control command binary code representative of a selected one of the two or more color LED's or LED sets to enable the selected one of the LED's to be controlled for adjusting its brightness.

According to a still further broad aspect of the present invention there is provided a method of independently adjusting the correlated color temperature (CCT) and brightness of a selected on of two or more color LED's or LED sets with each of the LED's or LED sets of an LED light source having a different correlated color temperature. The method generally comprises the following steps of:

(i) selecting by a control device one of the two or more color LED's or LED sets having a predetermined correlated color temperature and transmitting a selection signal representative thereof to signal conversion circuit means,
(ii) converting a power supply voltage waveform to produce a command waveform signal including a binary signal representative of the selection signal,
(iii) enabling the selected one of the two or more LED's or LED sets,
(iv) controlling by a further control device the brightness of the selected one of the two or more color LED's or LED sets by producing a dimming signal to adjust the brightness of the enabled selected one of the two or more color LED's or LED sets to create a desired light atmosphere in an environment lit by the two or more color LED's or LED sets and adjusting the brightness thereof, and
(v) repeating said steps (i) to (iv) for selecting a further of the two or more color LED's or LED sets and adjusting the brightness thereof.

According to a further broad aspect of the present invention the method provides automatically enabling a signal transmitting circuit having a controller receiving a signal at a first input thereof to instruct a signal conversion circuit to produce a located between a start bit and a stop bit of the binary signal for feeding a signal analyser to effect the step (iii). The transmitting circuit has a second input for receiving a dimming signal for operating a driver circuit to adjust the brightness of the selected one of the two or more color LED's or LED sets.

According to a still further broad aspect of the invention, the signal conversion circuit is a chopper semiconductor circuit for adjusting the conduction delay time of the sine wave of a 120 volt, 60 cycle supply voltage to produce the composite command waveform signal having said command binary signal corresponding to a selected one of said two or more color LED's or LED sets. The composite command waveform signal is fed to a signal analyser circuit to permit identification and enabling of the selected one of the two or more color LED's or LED sets and to provide for the adjustment of the brightness of the selected one of said two or more color LED's or LED sets.

BRIFE DESCRIPTION OF THE DRAWINGS

A preferred embodiment of the present invention will now be described with reference to the accompanying drawings in which;

FIG. 1 is a block diagram illustrating the connection between the signal transmitter and an LED light source connected to a signal analyzer;

FIG. 2 is a block diagram illustrating the configuration of the signal transmitter and associated component connection;

FIG. 3 illustrates the supply voltage half waveforms of the 10 zero crossings and the method of producing the command signal from the chopped supply voltage 60 cycle sine wave by specific voltage interruptions to produce a composite binary code identifying respective ones of two or more color LED's or LED sets;

FIG. 4 is a block diagram of the signal analyser circuit and its connection to two color LED's or LED sets of different color temperatures;

FIG. 5 is a detailed schematic diagram of the block diagram illustrated in FIG. 4, and FIG. 6 is a block diagram illustrating a modification wherein the selection and brightness control is effected by a wireless control device.

DESCRIPTION OF THE DRAWINGS

Hot line 13 supplies the power to the LED light source or light fixture 15, incorporating two or more color LED's or LED sets of different color temperature, through the signal analyzer 16 in two forms, depending on the type of signal transmitter 12. As shown, the signal transmitter 12 transmits a control signal to the LED light source 15 by means of a carrier wave through a cable 18. The cable 18 also bears the function of supplying power from the hot line 13 to the LED light sources 15. The signal from the signal transmitter 12 may also be transmitted to the LED light sources 15 in the form of radio frequency (RF) signal. In FIG. 1, hot line 13 supplies power to the LED light sources 15 through line 19. The connection cable 18 between the signal transmitting device 12 and the signal analyzer 16 of the LED light sources 15 represents the output frequency signal transmission line. As mentioned above, there is no wire connection if the signal is an RF radio frequency transmitted signal. Note that line 14 for the power supply is not necessary, when cable 18 connects the signal transmitter 12 to the LED light source 15, the neutral line 13' will be connected to the LED light source 15 and to the signal analyser circuit 16 through line 17, and the supply of power to the transmitter 12 will be through a feedback line in the cable 18.

Figure 1:
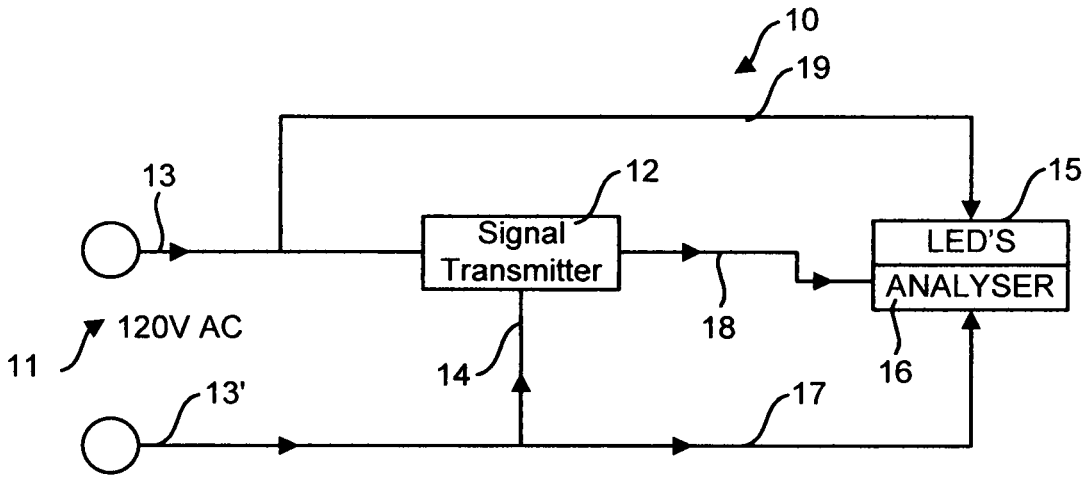
Referring to FIG. 1 there is shown generally at 10 a simplified illustration of the system of the present invention, herein connected to a 120 volts AC, 60 cycle common household outlet voltage supply 11. The supply voltage has its hot line 13 which is used to supply power to a signal transmitting device 12, and its neutral line 13' is used to supply power to the signal transmitting device 12 through connection line 14. The neutral line 13' also supplies power to an LED light source 15, which can be in the form of a lamp or other fixture, which is herein provided with a signal analyzer circuit 16 through connection line 17. The LED light source 15 is comprised of two or more color LED's or LED sets each having a specific correlated color temperature (CCT), and has illustrated in FIG. 4 one LED or LED set is of 2000 Kelvin temperature and the other LED or LED set is of 5000 Kelvin temperature. Although the signal analyser 16 is shown incorporated in a light fixture, it can be housed separately.
Figure 2:
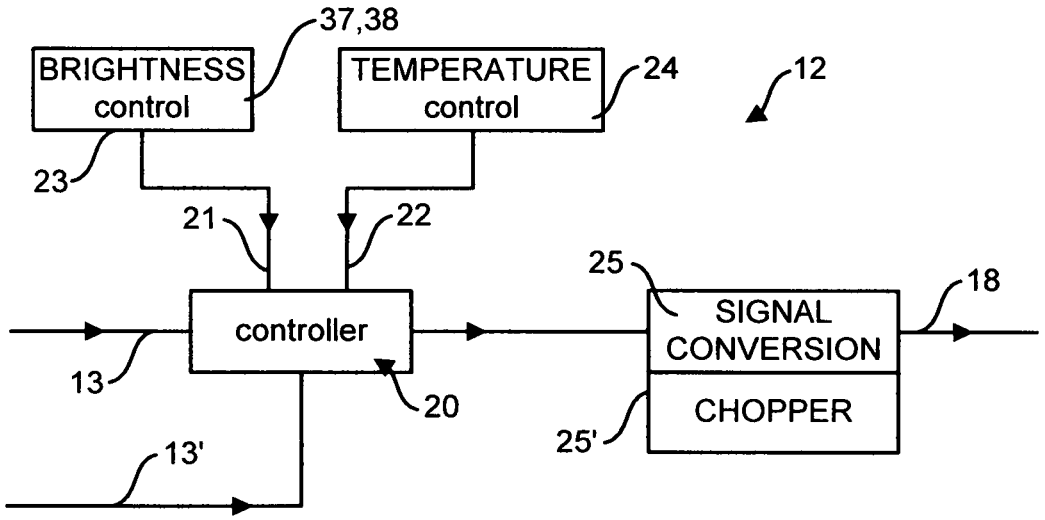
Referring to FIG. 2, there is illustrated the internal configuration of the signal transmitter 12. As shown, the transmitter circuit 12 has a controller 20 to which is connected two inputs 21 and 22. The input 21 is from a brightness control device 23 to provide a brightness command signal input dependent on the adjustment of the brightness control 23 by a user person (see control switch buttons 37 and38 of the control 30 of FIG. 6). Input 22 is from a selection switch device 24, also operated by the user person, selecting a desired one of the two or more color LED's of the LED light source having two or more color LED's of different color temperature (see control switch buttons 33 to 36 of the control 30 of FIG. 6). When the controller 20 receives a command color LED selection signal at its input 22 the selected color LED is identified and the controller outputs a control signal to a signal conversion circuit 25. When a brightness adjustment command signal is received at its input 21, the command brightness signal to adjust the color temperature of the selected color LED, the controller 20 will output a further control signal on cable 18 to the signal conversion circuit 25. The output control signal representative of the selected color temperature LED or LED set, fed to the signal converter circuit 25 which modifies the 60 cycle supply waveform by the chopper circuit 25' to generate a composite command waveform signal representative of a binary code signal identifying the selected color LED or LED set and is outputted on the cable 18 feeding the signal analyser circuit 16. It is pointed out that the user person selection device for selecting a specific color LED or LED set of a desired color temperature and adjusting the brightness thereof is provided form a wall mounted control unit 30, as mentioned above and illustrated in FIG. 6, and which is provided with switch buttons 31 to 38 for operation by a user person. The selection can also be done wirelessly by a remote wireless device, such as an iPhone 69 shown in FIG. 6.
Figure 3:
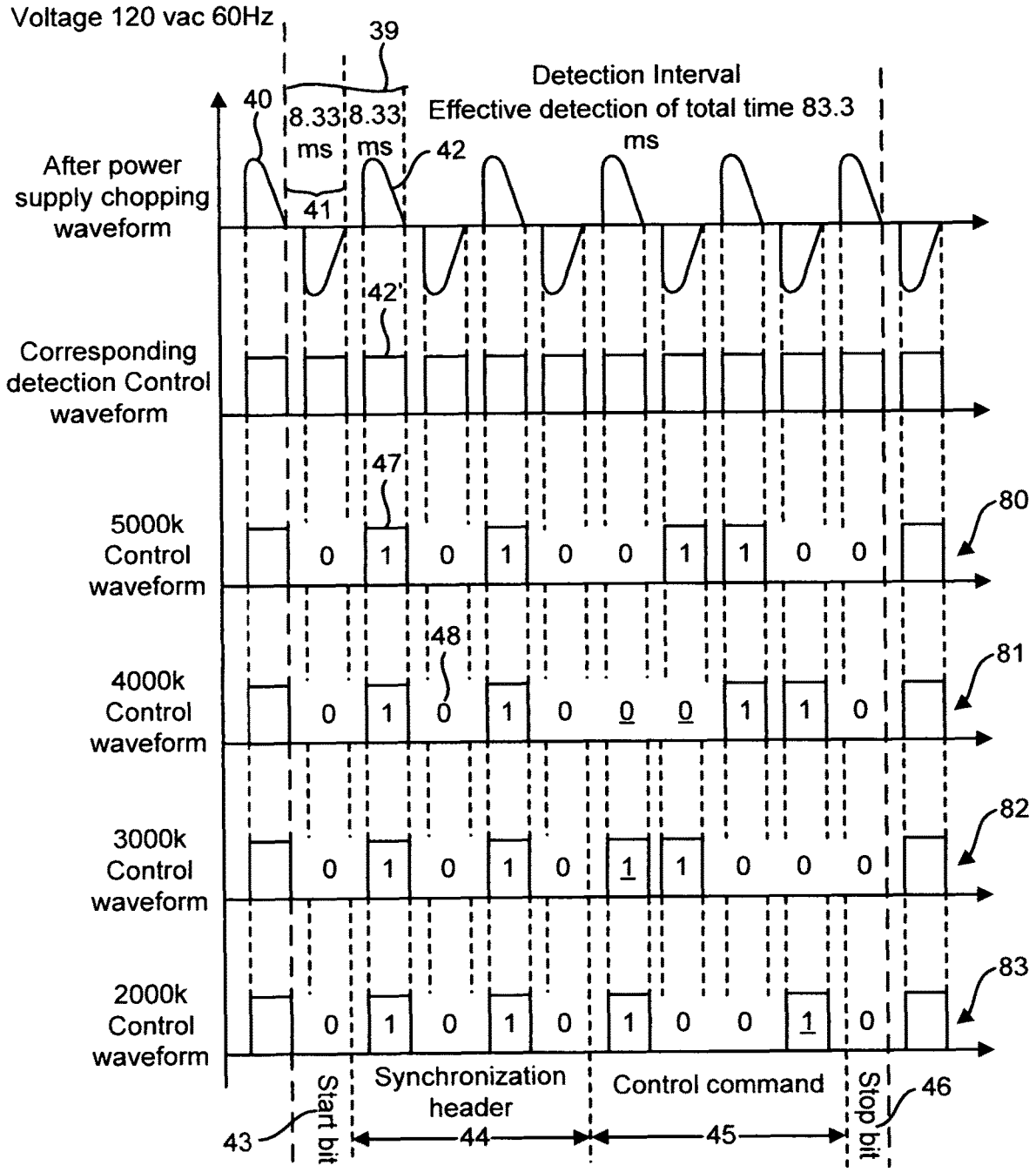
Figure 4:
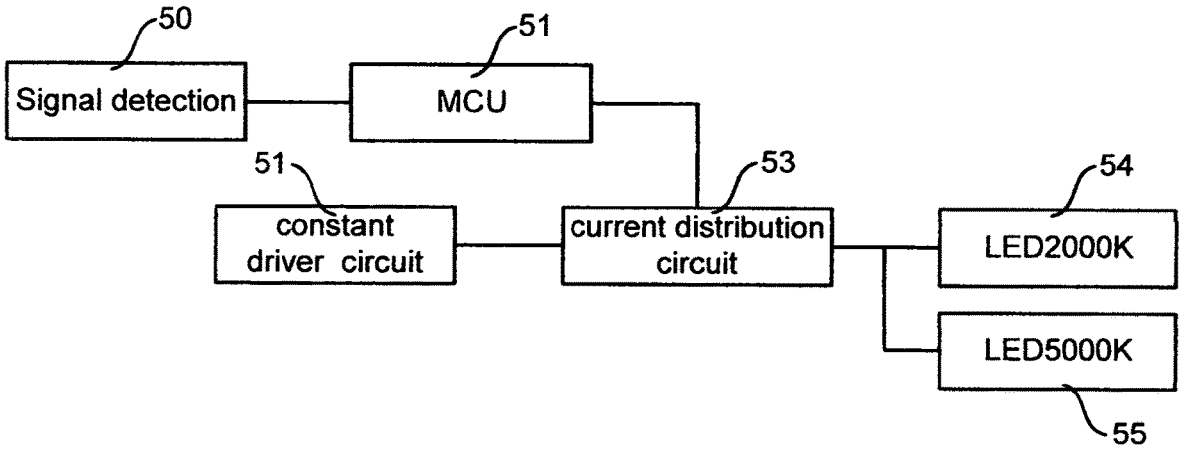

With additional reference to FIGS. 2, 3 and 4, there is illustrated the signal modulation inside the signal conversion circuitry 25. If the voltage supply input 11, as with the described embodiment, is 120 VAC/60 Hz, then the hot line 13 loaded into the signal transmitting device 12 is a 60 cycle sine wave 39. In order to select a desired color LED or LED set to be adjusted in brightness brightness, the signal conversion device 25 has a chopper semiconductor device 25', which can be a silicon controller rectifier, thyristor or MOS, etc, to modify the supply voltage waveform. The signal output from the user person control unit 30 is sent to the controller 20 which instructs the signal conversion circuit 25 and, at which time, the signal chopper circuit 25', of the signal conversion circuit 25, can adjust the conduction delay time of the sine wave of the supply voltage frequency depending on the control signal received from the controller 20 to output a code command waveform having ten (10) binary digits or bits created by sequences by turning power ON and OFF every half cycle. A code is created by an output waveform 42 in the half cycle 41 and a code ) represents no output in the half cycle. . . Thus, a composite command waveform from the signal conversion device 25 is transmitted to the LED light source 15 through the signal analyser device 16 via the cable connection 18. By adjusting the chopping time in the signal conversion device 25 according to the control signal received from the controller 20 and depending on its input signal at input 22, as selected by the user person, the selected color LED's or LED sets 54 or 55 (see FIG. 4) is identified and enabled to receive the supply voltage which can be adjusted by the user person to the desired brightness by the use of the button switches 37 and 38 or other dimming means, mechanical or electronic.

With continuing reference to FIG. 3, and describing the generation of a binary signal to indentify the selected color LED or LED set, see signals 80 to 83 associated with respective ones of four different color LED's or LED sets when the frequency of the power supply 10 is 60 Hz, the half period of the sine wave after power chopping is 8.3 ms, as shown at 41 and this is defined has a pulse waveform 42 interval. When the sine wave has a half cycle period the waveform output in the 8.3 ms half cycle period, the pulse waveform 42' is high level representing a digit 1. If the sine wave has no waveform output in the 8.3 ms half cycle period, the pulse wave 42 is low level representing a digit 0. The detection principle performs data discrimination by detecting the presence or absence of waveforms in 10 power supply zero-crossing intervals. In order to achieve the stability of control detection, the data frame structure has a start bit 43, a synchronization header 44 of four bits, a control command 45 of also four bits and a stop bit 46. During the period of 8.33 ms, if a pulse is detected, it is a high level "1", as shown by numeral 47. If no pulse is detected it is a low level "0", as shown by numeral 48. It is noted that the duty cycle waveform within the detection cycle will be consistent.

As an example, we define sending a 4-bit synchronization header 44 as valid starting data and define the synchronization header command as binary bits 1010. After the synchronization header 43, the data definition of the control command signal 45 can be very extensive. Considering that the commonly used color temperatures in the market are 5000K, 4000K, 3000K and 2000K, we define these four color temperatures by control command data binary bits 0110, 0011, 1100 and 1001, respectively, in a control command portion of the data frame structure. Therefore, when the user person selects the color temperature on the control device 30, the controller 20 transfers the command signal of the selected color LED to the signal conversion device 25 through the cable 18 according to the command information selected by the user person. The signal conversion device periodically sends out and judges the waveform according to the two-dimensional code information sent by the controller 20 by the control device 30.

Figure 5:
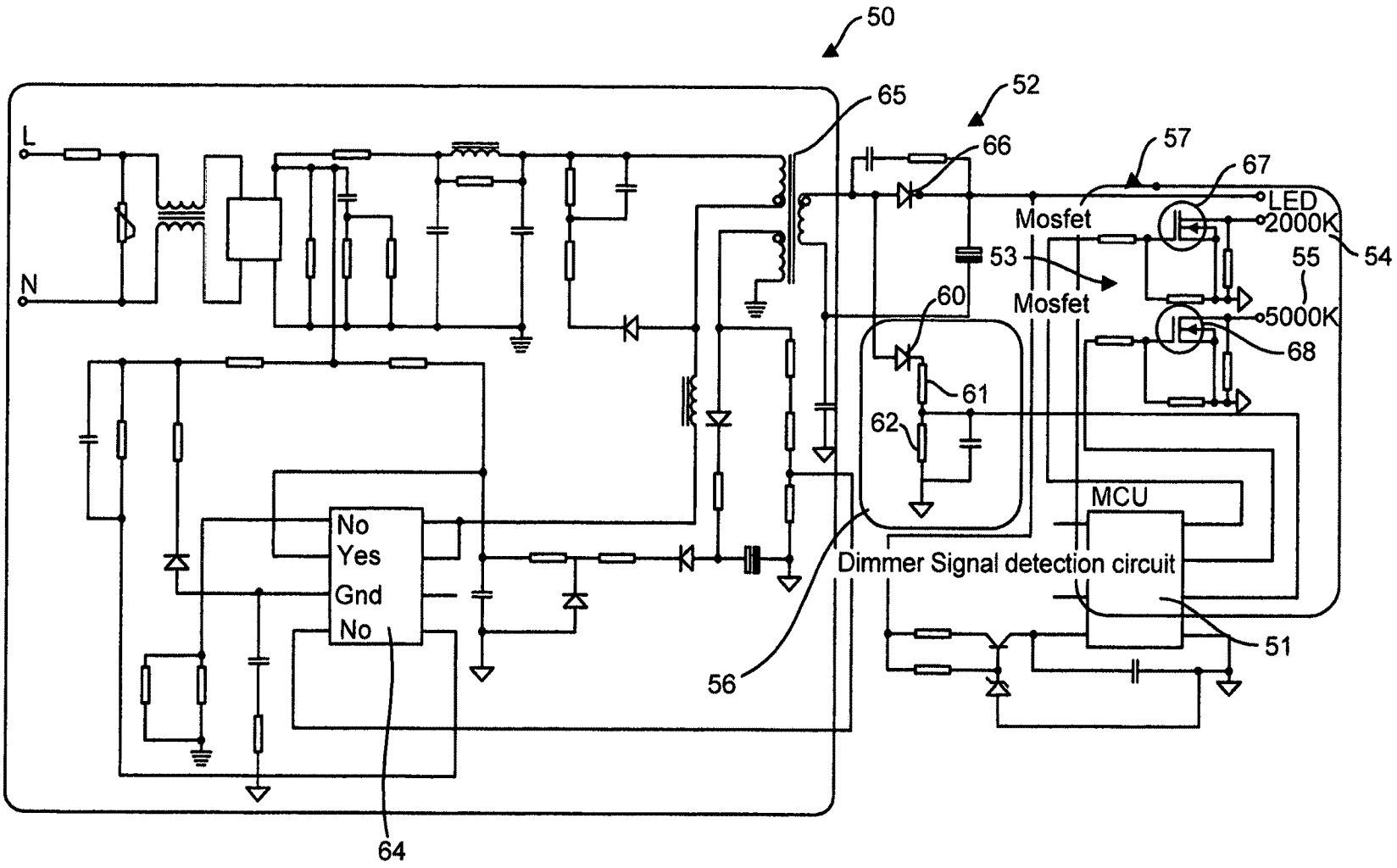

With additional reference to FIG. 5, the signal analyser device 16 is composed of signal detection circuit 50 equipped with a microcontroller MCU 51 , a constant driver circuit 52, a current distribution circuit 53 and LED chips 54 and LED chips 55. Signal detection circuit 56 receive the signal from signal transmitter 12, and analyses the signal in the MCU 51. Constant driver circuit 52 is supplying the constant current to drive the sets of LED chips 54 and 55. The output current from constant driver circuit 52 is controlled by MCU 51. Meanwhile, constant circuit output current from the constant drive circuit 52 is fed to the current distribution circuit 53 to drive the sets of LED chips 54 and 55 herein forming two sets of LED chips of different color temperature, namely 5000K and 2000K. The current from current distribution circuit 53 to drive the sets of LED chips is controlled by the MCU 51. The MCU 51 also stores in memory the latest brightness adjustment signal of each of the color LED's to maintain the selected brightness of each color LED to produce a combined brightness adjustment to produce the selected light atmosphere.

The circuitry 49 represents the dimming circuit portion connected to the dimmer device operated by the switch control buttons 37 and 38 and an example of the adjustment of such is described by reference to U.S. Pat. No. 10,159,131 issued Dec. 18, 2018 to Adam Chaimberg one of the inventors of the present invention describing the brightness adjustment circuit functioning. This patent is herein incorporated by reference.

The signal detection circuit 56 is composed of diode 60, divider resistances 61 and 62, and a filter capacitor 63. Constant circuit 52 is composed of a master switch driver control ICU 64, transformer 65, diode 66 and other external devices. Current distribution circuit 57 is composed of MOS 67, 68 and associated resistances. The MCU 51 controls the current distribution through the MOS 67 and 68. MOS 67 and MOS 68 correspond to the two different color temperature of the two sets LED 54 and 55. The different current distribution to the two sets of LED's being different, will result in mixed light to produce a desired light atmosphere.

Figure 6:
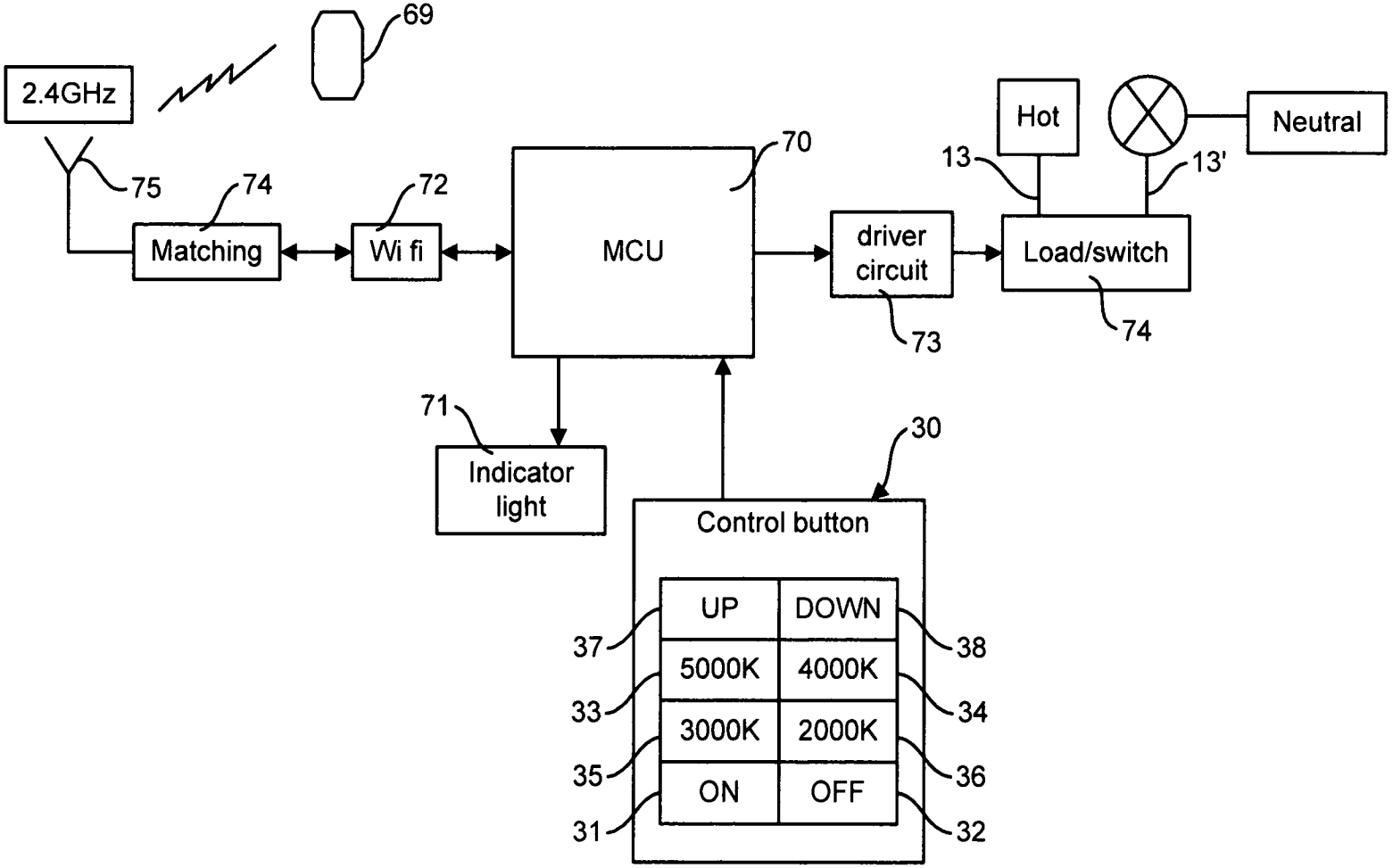
As shown in FIG. 6, the control unit 30 has a button 31 and 32 to switch the power to the LED source 15 ON and OFF. Buttons 33, 34, 35 and 36 permit selection for enabling one, two or more herein four different color LED's, as illustrated, one LED of 5000 Kelvin color chips, 4000 Kelvin chips, 3000 Kelvin chips and 2000 Kelvin temperature chips. Once a specific color LED is selected, the brightness of the selected LED can be adjusted by depressing the buttons 37 or 38 to cause the illumination or brightness of the LED to increase or decrease in intensity. It is further pointed out that the control unit can be of an electronic type and controlled wirelessly using Bluetooth, WiFi, Zifbee, Zwave or other suitable wireless communication technology.

FIG. 6 illustrates one of several possible modifications of the invention and has herein illustrated, the control device 30 can be stored as an application in a mobile device 69, such as one of an iphone, a tablet, a computer, a portable computer or any other wireless communication device, for communication with the microcontroller MCU 70. With such modification, the wall mounted control unit may not be necessary although both forms of controls may be used. As shown an indictor light 71 provides an indication that the MCU is in an "ON" engaged mode of operation. As illustrated the MCU 70 receives switch activation data from the mobile device 69 through a receiving antenna 75, a matching circuit 74 and a WiFi wireless communication link 72. The MCU 70 which processes the selected commands inputted by the user person to provide the command waveform signal to the driver circuit 73 to select the LED or LED set to be controlled. It by further generates the control signals to drive the selected LED or LED set in the LED light source, herein the load 74, to adjust the brightness of the selected LED or LED set. It is further pointed out that the MCU 70 can have a programmed function in its memory to also store desired adjustments made by the user person upon instructions by the user person to do so.

It is within the ambit of the present invention to cover all obvious modifications of the examples of the preferred embodiment described herein provide such modifications fall within the scope of the appended claims.

The invention claimed is:

1. A system for permitting a user person to independently adjust the correlated color temperature (CCT) and brightness of a selected one of two or more color LED's or LED sets of an LED light source, and wherein each said two or more color LED's or LED sets have a different correlated color temperature, said system comprises a signal transmitting circuit having a controller for receiving a selection signal identifying said selected one of said one or more color LED's or LED sets and transmitting a representative control signal to a signal conversion circuit which generates a command waveform which has incorporated therein a binary signal identifying said selected one of said two or more color LED's or LED sets to a signal analyser which identifies said selected one of said LED's or LED sets and establishes a connection to said selected one of said LED's or LED sets to receive a dimming brightness signal to adjust the brightness of said selected one of said two or more color LED's or LED sets to create a desired light atmosphere in an environment lit by each said two or more color LED's or LED sets, said controller of said signal transmitting circuit having two input connections, one of said input connections for receiving a color temperature selection signal and the other of said connections for receiving a control brightness adjustment signal for brightness intensity adjustment, said signal conversion circuit incorporating a chopper semiconductor circuit responsive to said color temperature selection signal to adjust the conduction delay time of a sine wave supply voltage of a power supply voltage waveform to adjust said command waveform containing a binary signal to identify said selected color LED or LED set representative by said color temperature selection signal at said one of said input connections to enable said selected one of said two or more of said color LED's or LED sets for providing connection for receiving said color brightness adjustment signal for adjustment of the brightness thereof.

2. The system as claimed in claim 1 wherein said selection signal for selectively enabling a selected one of said two or more color LED's or LED sets and to adjust the brightness thereof is generated by one of a mechanical switch and a wireless electronic control devices.

3. The system as claimed in claim 2 wherein said wireless electronic control device is a wireless device utilizing one of Bluetooth, WiFi, Zigbee, Zwave or other suitable wireless communication technology protocol.

4. The system as claimed in claim1 wherein said signal transmitting circuit transmits said command waveform through one of a cable connection and a wireless RF (radio frequency) signal.

5. The system as claimed in claim 1 wherein said signal transmitting circuit has an input connection to a 120 volt AC, 60 cycle sine wave supply voltage, said signal conversion circuit modifying the half wave periods of the sine wave of the power supply by switching on and off to produce a command waveform having a composite binary signal identifying said selected one of said two or more color LED's or LED sets.

6. The system as claimed in claim 5 wherein said composite binary signal is derived by data discrimination by detecting the presence or absence of half wave periods of said sine wave in 10 power supply zero-crossing intervals and wherein the half wave period of said 60 cycle sine wave is 8.33 ms, and wherein if said half wave periods of said sine wave has a waveform the pulse waveform corresponds to a binary 1 bit and if there is no waveform it corresponds to a binary 0 bit.

7. The system as claimed in claim 5 wherein there are two of said color LED's or LED sets, one of said color LED's or LED sets having a correlated color temperature (CCT) of 5000 Kelvin and the other of said color LED's having a correlated color temperature of 2000 Kelvin and identified respectively by a binary signal of 0110 and 1001.

8. The system as claimed in claim 7 wherein said 8 power supply zero-crossing interval has a data bit frame structure comprised of a start bit followed by a synchronization header of 4 bits, a control command of 4 bits identifying said selected one of said two or more color LED's or LED sets, and a stop bit.

9. The system as claimed in claim 7 wherein there are four color LED's or LED sets, a third color LED or LED set having a correlated color temperature of 4000 Kelvin and fourth color LED or LED set having a correlated color temperature of 3000 Kelvin identified respectively by a binary signal of 0011 and 1100.

10. The system as claimed in claim 5 wherein said chopper semiconductor circuit is one of a silicon control rectifier, thyristor and MOS and other suitable rectifier circuit.

11. A method of independently adjusting the correlated color temperature (CCT) and brightness of a selected one of two or more color LED's or LED sets of an LED light source with each of said color LED's or LED sets having a different correlated color temperature, said method comprising the steps of:

(i) selecting by a control device one of said two or more color LED's or LED sets having a predetermined correlated color temperature and transmitting a selection signal representative thereof to signal conversion circuit means, (ii) converting a power supply voltage waveform to produce a command waveform signal including a binary signal representative of said selection signal, (iii) enabling said selected one of said two or more LED's or LED sets, (iv) controlling by a further control device the brightness of said selected one of said two or more color LED's or LED sets by producing a dimming signal to adjust the brightness of said enabled selected one of said two or more color LED's or LED sets to create a desired light atmosphere in an environment lit by said two or more color LED's or LED sets and adjusting the brightness thereof, said steps (i) and (iv) automatically enables a signal transmitting circuit having a controller receiving a signal at a first input thereof to instruct a signal conversion circuit to produce a composite command waveform signal including a control command binary signal located between a start bit and a stop bit of said binary signal for feeding a signal analyser to effect said step (iii) and a second input for receiving a dimming signal for operating a driver circuit to adjust the brightness of said selected one of said two or more color LED's or LED sets, said signal conversion circuit having a chopper semiconductor circuit for adjusting the conduction delay time of the sine wave of a 120 volt, 60 cycle supply voltage to produce said composite command waveform signal having said command binary signal corresponding to a selected one of said two or more color LED's or LED sets and feeding said composite command waveform signal to said signal analyser circuit to permit identification and enabling of said selected one of said two or more color LED's or LED sets and to adjust the brightness of said selected one of said two or more color LED's or LED sets, and (v) repeating said steps (i) to (iv) for selecting a further of said two or more color LED's or LED sets and adjusting the brightness thereof.

12. The method as claimed in claim 11 wherein said steps (i) to (iii) of selecting and controlling is effected by use of selected switches of a mechanical switch, and operating by use of a remote wireless control device to select a desired color LED or LED set of said two or more color LED's or LED sets and adjusting the brightness thereof.

13. The method as claimed in claim 11 wherein said binary signal is derived in a data bit frame structure by detecting the presence or absence of half wave periods of the sine wave in 10 power supply zero-crossing intervals of said power supply voltage, and wherein the half-wave period of said 60 cycle sine wave is 8.33 ms, and wherein if said half wave periods of said sine wave has a waveform the pulse waveform corresponds to a binary "1" bit, and if there is no waveform it corresponds to a binary "0" bit.

14. wherein said signal conversion circuit is a chopper semiconductor circuit for adjusting the conduction delay time of the sine wave of a 120 volt, 60 cycle supply voltage to produce said composite command waveform signal having said command binary signal corresponding to a selected one of said two or more color LED's or LED sets and feeding said composite command waveform signal to a signal analyser circuit to permit identification and enabling of said selected one of said two or more color LED's or LED sets and to adjust the brightness of said selected one of said two or more color LED's or LED sets.

* * * * *